US007431029B2

(12) United States Patent
Kim et al.

(10) Patent No.: US 7,431,029 B2
(45) Date of Patent: Oct. 7, 2008

(54) COOLING APPARATUS OF COOKING APPLIANCE

(75) Inventors: Yang Kyeong Kim, Buchun-si (KR); Jae Kyung Yang, Seoul (KR); Wan Soo Kim, Kwangmyung-si (KR); Jong Sik Kim, Koyang-si (KR)

(73) Assignee: LG Electronics Inc., Seoul (KR)

( * ) Notice: Subject to any disclaimer, the term of this patent is extended or adjusted under 35 U.S.C. 154(b) by 418 days.

(21) Appl. No.: 11/039,790

(22) Filed: Jan. 24, 2005

(65) Prior Publication Data

US 2005/0223912 A1 Oct. 13, 2005

(30) Foreign Application Priority Data

Apr. 12, 2004 (KR) ..... 10-2004-0025003

(51) Int. Cl.
*F24C 15/04* (2006.01)

(52) U.S. Cl. ..... 126/198; 126/193; 126/21 A

(58) Field of Classification Search ..... 126/200, 126/193, 198, 21 R, 77, 80, 21 A; 219/757
See application file for complete search history.

(56) References Cited

U.S. PATENT DOCUMENTS

| | | | | |
|---|---|---|---|---|
| 4,163,444 | A * | 8/1979 | Drouin | 126/198 |
| 4,716,884 | A | 1/1988 | Bonaccorsi et al. | |
| 5,387,258 | A | 2/1995 | Puricelli | |
| 5,918,589 | A | 7/1999 | Valle et al. | |

FOREIGN PATENT DOCUMENTS

| | | | |
|---|---|---|---|
| DE | 100 47 016 | A1 | 4/2002 |
| EP | 0 752 561 | A1 | 1/1997 |
| EP | 0 900 985 | A1 | 3/1999 |
| EP | 964208 | * | 12/1999 |
| EP | 1 022 517 | A1 | 7/2000 |
| FR | 2 726 633 | A1 | 5/1996 |
| JP | 59-44528 | A | 3/1984 |

* cited by examiner

*Primary Examiner*—Alfred Basichas
(74) *Attorney, Agent, or Firm*—Birch, Stewart, Kolasch & Birch, LLP

(57) ABSTRACT

A cooling apparatus of a cooking appliance including a cabinet having a cooking chamber located therein and an electric component chamber located outside the cooking chamber; a door installed on the cabinet for opening and closing the cooking chamber, and having a suction channel and a discharge channel communicating with the electric component chamber; and an air blower installed in the electric component chamber for sucking air to the inside of the electric component chamber through the suction channel and the discharge channel of the door and discharging the air, so that the external air having a low temperature is directly sucked through the door, cools the electric component chamber, and is then discharged to the outside, thereby increasing cooling efficiency of the door.

17 Claims, 7 Drawing Sheets

COOLING APPARATUS OF COOKING APPLIANCE

BACKGROUND OF THE INVENTION

1. Field of the Invention

The present invention relates to a cooling apparatus of a cooking appliance, such as an oven, and more particularly, to a cooling apparatus of a cooking appliance for cooling an electric component chamber and a door.

2. Description of the Related Art

FIG. 1 is a partially exploded perspective view of a cooking appliance, particularly an oven, and FIG. 2 is a sectional view of FIG. 1, taken along line A-A.

The oven as shown in FIG. 1 comprises a cabinet 1 having an opened front surface, a cooking chamber 2 installed in the cabinet 1 and heated such that food therein is cooked, a door 10 installed on the opened front surface of the cabinet 1 for opening and closing the cooking chamber 2, and an air blower 4 installed in an electric component chamber 3 located on the upper part of the cooking chamber 2 for cooling electric components in the cabinet 1.

The cooking chamber 2 is heated by an electric heater or a burner.

The air blower 4 serves to form a cooling channel due to a high temperature generated when the oven performs a cooking operation and an automatic cleaning operation using pyrolysis, and generally includes a fan 7 and a fan motor 6 for operating the fan 7.

The fan 7, as shown in FIG. 2, is installed at the rear part of the electric component chamber 3, and forcibly discharges air in the electric component chamber 3 toward the front part of the electric component chamber 3, at which the door 10 is placed, thereby cooling the air in the electric component chamber 3.

The door 10 is directly heated by heat radiated and heat convected from the inside of the cooking chamber 2, thus having a cooling structure. The cooling structure of the door 10 is configured such that a channel 13 for passing external air is formed between two glass plates 11 disposed in parallel.

The above channel 13 of the door 10 is connected to a discharge channel 8 of the fan 7.

Accordingly, when the air in the electric component chamber 3 is forcibly discharged by the fan 7, the hot current of air in the door 4 is exhausted to the outside and cooled by the principle of sucking the air passing through the door 10 according to Bernoulli's Equation using a difference of velocities of an exhausted air flow.

Here, various cooking appliances, such as an oven and a microwave oven, use a pyrolysis system for increasing the temperature of the cooking chamber 2 when the cooking chamber 2 is cleaned, and perform a cleaning operation using the pyrolysis system in a state, in which the temperature of the cooking chamber 2 is more than 500° C., thereby requiring a cooling structure of the door 10 for coping with the above condition.

Further, the above cooking appliances requires a new cooling structure of the door 10, in which food therein is cooked at a temperature of more than 250° C.

However, since the above-described conventional cooling structure of the cooking appliance is configured such that the air in the door 10 is sucked and discharged by means of a difference of velocities of the air discharged from the electric component chamber 3, in case that the quantity of the air current for cooling the door 10 is small and the blowing force of the fan 7 is deteriorated due to long-term use, the air discharged from the electric component chamber 3 flows again into the channel 13 of the door 10, thereby remarkably deteriorating the cooling efficiency of the door 10.

Particularly, the above-described conventional cooling structure of the door 10 is not suitable for cooking appliances, which perform a cooking operation at a high temperature and a cleaning operation using pyrolysis.

SUMMARY OF THE INVENTION

Therefore, the present invention has been made in view of the above problems, and it is an object of the present invention to provide a cooling apparatus of a cooking appliance, which sucks air from the outside through a door and then uses the air to cool the inside of a cabinet, thereby increasing cooling efficiency of the door and an electric component chamber.

In accordance with one aspect of the present invention, the above and other objects can be accomplished by the provision of a cooling apparatus of a cooking appliance comprising: a cabinet having a cooking chamber located therein and an electric component chamber located outside the cooking chamber; a door installed on the cabinet for opening and closing the cooking chamber, and having a suction channel and a discharge channel communicating with the electric component chamber; and an air blower installed in the electric component chamber for sucking air to the inside of the electric component chamber through the suction channel and then discharging the air through the discharge channel.

Preferably, the door may include a plurality of plate members spaced from each other by a designated interval, and the suction channel and the discharge channel are formed among the plate members.

More preferably, the door may include at least three glass plate members.

Preferably, the suction channel may be located at the outer portion of the door, and the discharge channel may be located at the inner portion of the door.

Further, a discharge duct for discharging the air in the electric component chamber may be formed from an outlet of the air blower to the discharge channel of the door, or a suction duct may be connected from the suction channel of the door to an inlet of the air blower.

In accordance with another aspect of the present invention, there is provided a cooling apparatus of a cooking appliance, in which external air passes through a door installed on a front surface of a cabinet to cool the door, flows into the cabinet to cool internal components, such as a control panel for controlling cooking operation, and electric components in an electric component chamber in the cabinet, and is then discharged to the outside of the cabinet.

Preferably, the air discharged to the outside of the cabinet may be discharged toward an area in front of the door and the cabinet.

Further, preferably, a suction channel for sucking the external air into the cabinet and a discharge channel for discharging the air in the cabinet to the outside may be formed in the door.

More preferably, the suction channel and the discharge channel may be separated from each other by a plurality of plate members constituting the door.

Preferably, an air blower for circulating the air to cool the door and the inside of the cabinet may be provided in the cabinet.

The cooling apparatus of the cooking appliance of the present invention causes external air to be directly sucked into the cabinet through the door, to cool the inside of the electric component chamber, and to be then discharged to the outside, thereby increasing cooling efficiency of the door.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the annexed drawings.

Figure 1:
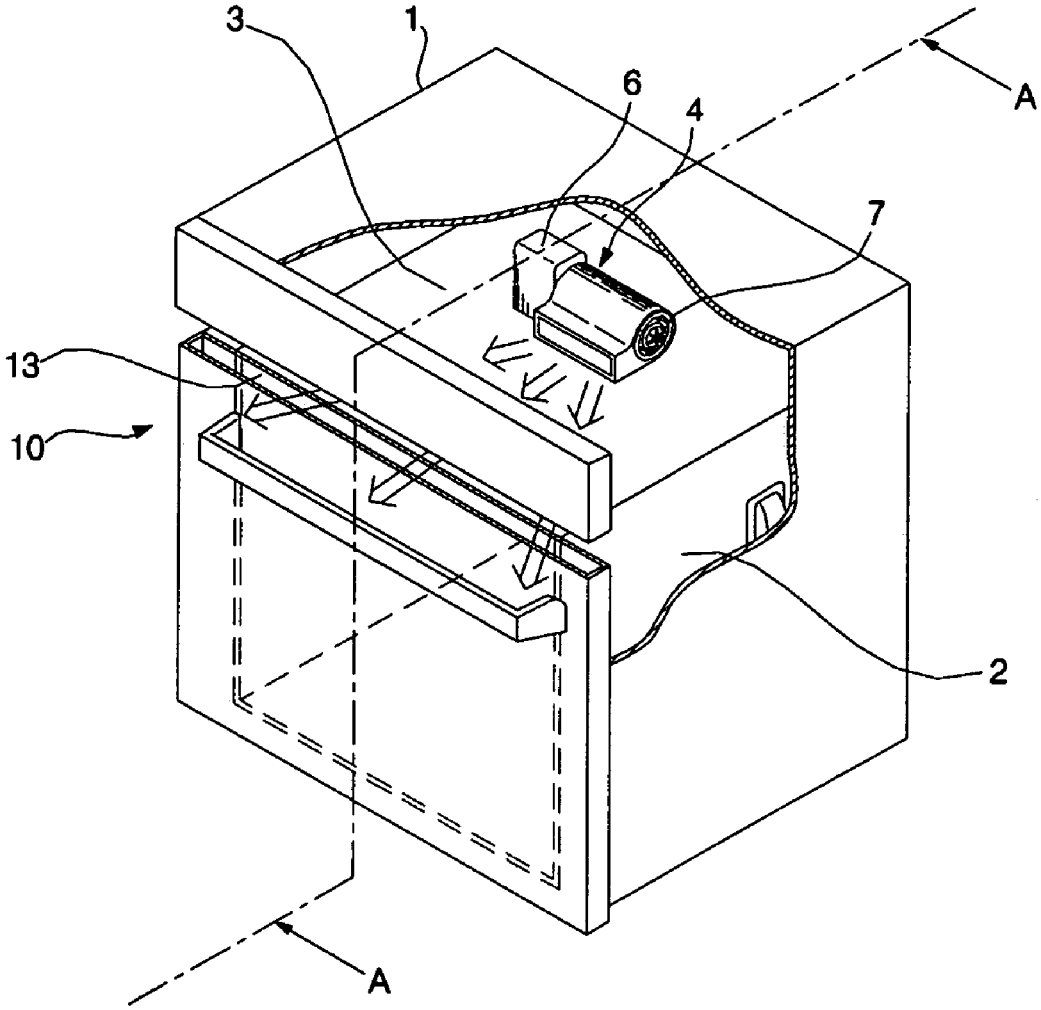
FIG. 1 (Prior Art)
FIG. 1 is a partially exploded perspective view of a cooking appliance having a conventional cooling apparatus.
Figure 2:
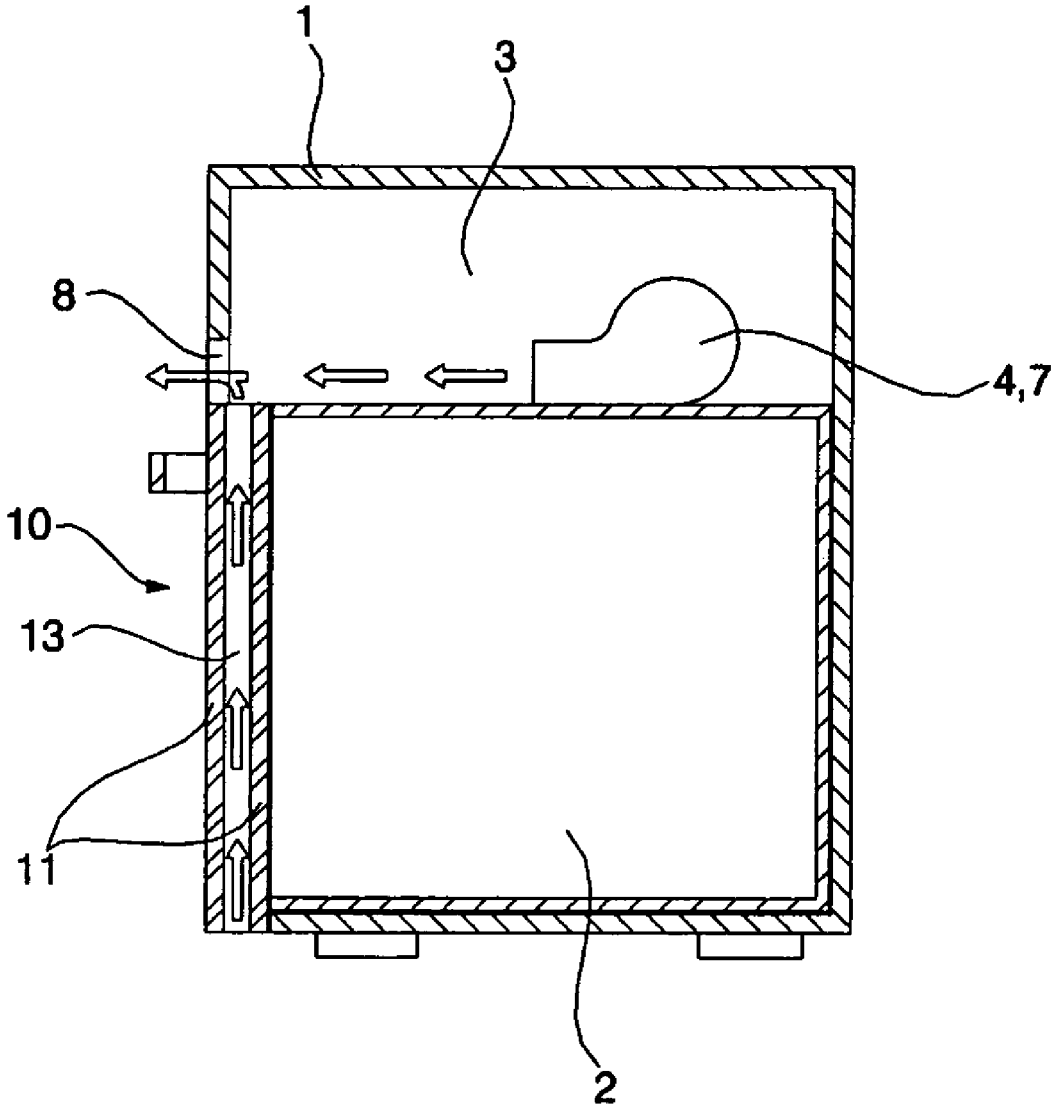
FIG. 2 (Prior Art)
FIG. 2 is a sectional view of FIG. 1, taken along line A-A.
Figure 3:
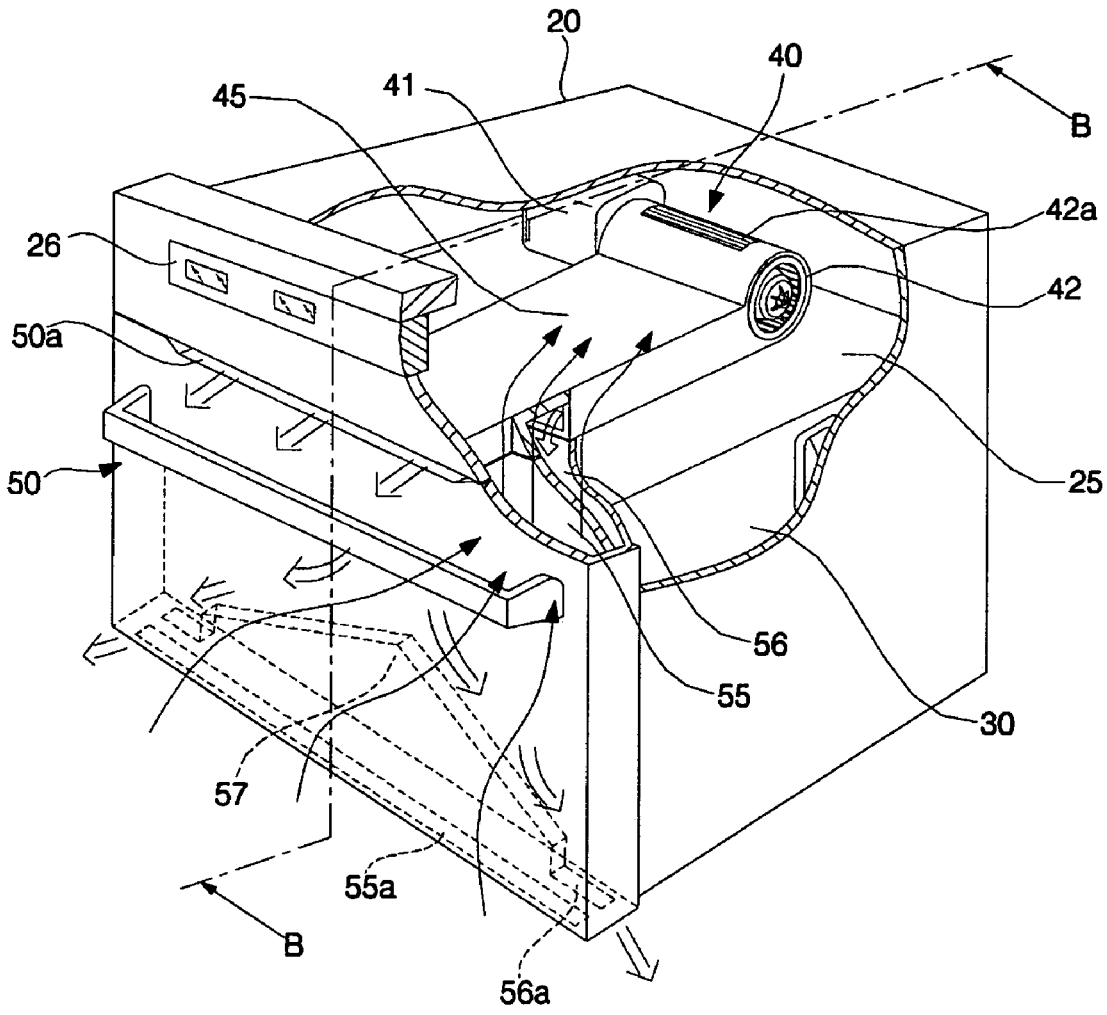
FIG. 3 is a partially exploded perspective view of a cooking appliance having a cooling apparatus in accordance with a first embodiment of the present invention.
Figure 4:
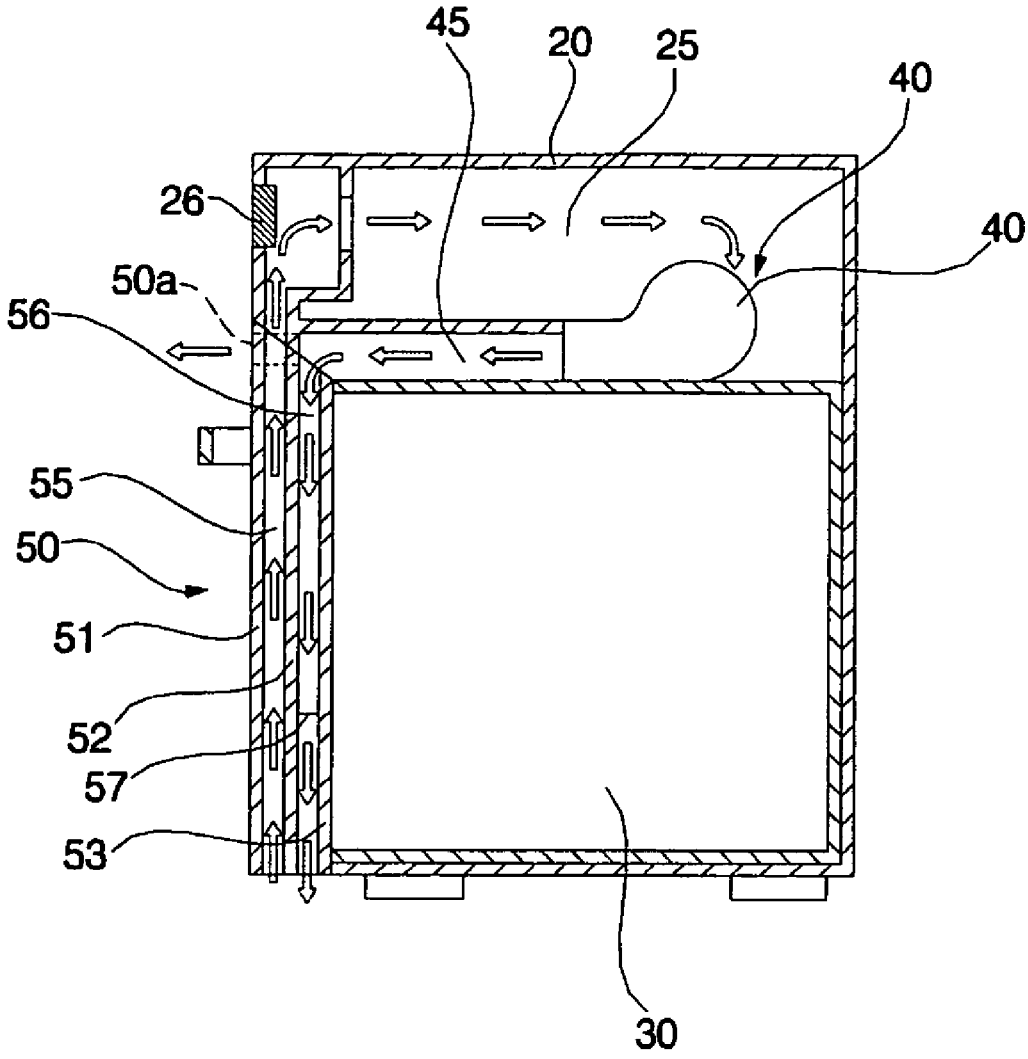
FIG. 4 is a sectional view of FIG. 3, taken along line B-B.

FIG. 3 is a partially exploded perspective view of a cooking appliance having a cooling apparatus in accordance with a first embodiment of the present invention, and FIG. 4 is a sectional view of FIG. 3, taken along line B-B.

FIG. 3 illustrates an oven provided with a cooling apparatus in accordance with the present invention. The oven comprises a cabinet 20 provided with a cooking chamber 30 heated by a heater and en electric component chamber 25 located on the upper part of the cooking chamber 30, a door 50 installed on the front surface of the cabinet 20 for opening and closing the cooking chamber 30, and an air blower 40 installed in the electric component chamber 25 in the cabinet 20 for sucking external air and then discharging the air so as to cool the door 50 and the inside of the electric component chamber 25.

Various electric components and devices, such as a control panel 26 for controlling the oven, are installed in the electric component chamber 25 of the cabinet 20.

The door 50 includes a suction channel 50 connected to the electric component chamber 25 for sucking the external air, and a discharge channel 56 for discharging the air having cooled the inside of the electric component chamber 25. An outlet 50*a* for discharging a part of the air having cooled the inside of the electric component chamber 25 together with the discharge channel 56 is additionally formed through the upper part of the door 50.

That is, the external air, which flows into the oven through the suction channel 55 of the door 50 by the operation of the air blower 40, cools the door 50 and the inside of the electric component chamber 25. Thereafter, after the air flows into the electric component chamber 25 to cool the inside of the electric component chamber 25, the air is discharged to the outside through the outlet 50*a* and the discharge channel 56 of the door 50.

A plurality of glass plate members 51, 52, and 53 are spaced from each other by a designated interval, and then the suction channel 55 and the discharge channel 56 are respectively formed between the glass plate members 51 and 52 and between the glass plate members 52 and 53. In this embodiment, the three glass plate members 51, 52, and 53 are disposed in parallel, thereby constituting the suction channel 55 and the discharge channel 56.

Preferably, the suction channel 55 is located at the outer portion of the door 50, and the discharge channel 56 is located at the inner portion of the door 50. An inlet 55*a* of the suction channel 55 and an outlet 56*a* of the discharge channel 56 are formed through the lower part of the door 50.

Further, preferably, the upper end of the suction channel 55 is formed closely to one side of the upper end of the door 50 (the right side in FIG. 3) so that the suction channel 55 does not interfere with a discharge duct 45 and the control panel 26, or is formed at both sides of the upper end of the door 50 (not shown).

A guide 57 for guiding the cooled air into two sides is installed in the discharge channel 56.

The air blower 40 includes a motor 41, and a fan 42, in the same manner as a conventional air blower. Preferably, the fan 42 is a cross flow fan including an inlet 42*a*, which is longitudinally formed, and an outlet.

A discharge duct 45 for discharging the air in the electric component chamber 25 is formed from the outlet of the air blower 40 to the outlet 50*a* and the discharge channel 56 of the door 50.

Hereinafter, the function of the above cooling apparatus of the cooking appliance in accordance with one embodiment of the present invention will be described in detail.

The motor 41 installed in the electric component chamber 25 of the cabinet 20 is driven by current applied thereto, and then the motor 41 operates the fan 42 to circulate air.

External air is sucked to the inside of the electric component chamber 25 through the suction channel 55 of the door 50 by the fan 42. Here, the sucked air cools the door 50.

The air sucked into the electric component chamber 25, while cooling the door 50, cools the inside of the electric component chamber 25, and is then discharged to the discharge duct 45 by the fan 42. The air, discharged into the discharge duct 45, flows into the outlet 50*a* and the discharge channel 56 of the door 50 and is then discharged to the outside of the door 50. Here, the air circulating into the discharge channel 56 has a temperature higher than that of the sucked air, but exchanges heat with the discharge channel 56 of the door 50 having a comparatively high temperature, thereby cooling the door 50 one more time.

Accordingly, the cooling apparatus of the cooking appliance of the present invention allows the cooled air to be sucked into and discharged from the cooking appliance through the door 50, thereby increasing cooling capacity of the door 50.

Now, other embodiments of the present invention will be described in detail. Some parts in these embodiments, which are substantially the same as those in the first embodiment, are denoted by the same reference numerals even though they are depicted in the different drawings, and detailed descriptions thereof will thus be omitted because they are considered to be unnecessary.

Figure 5:
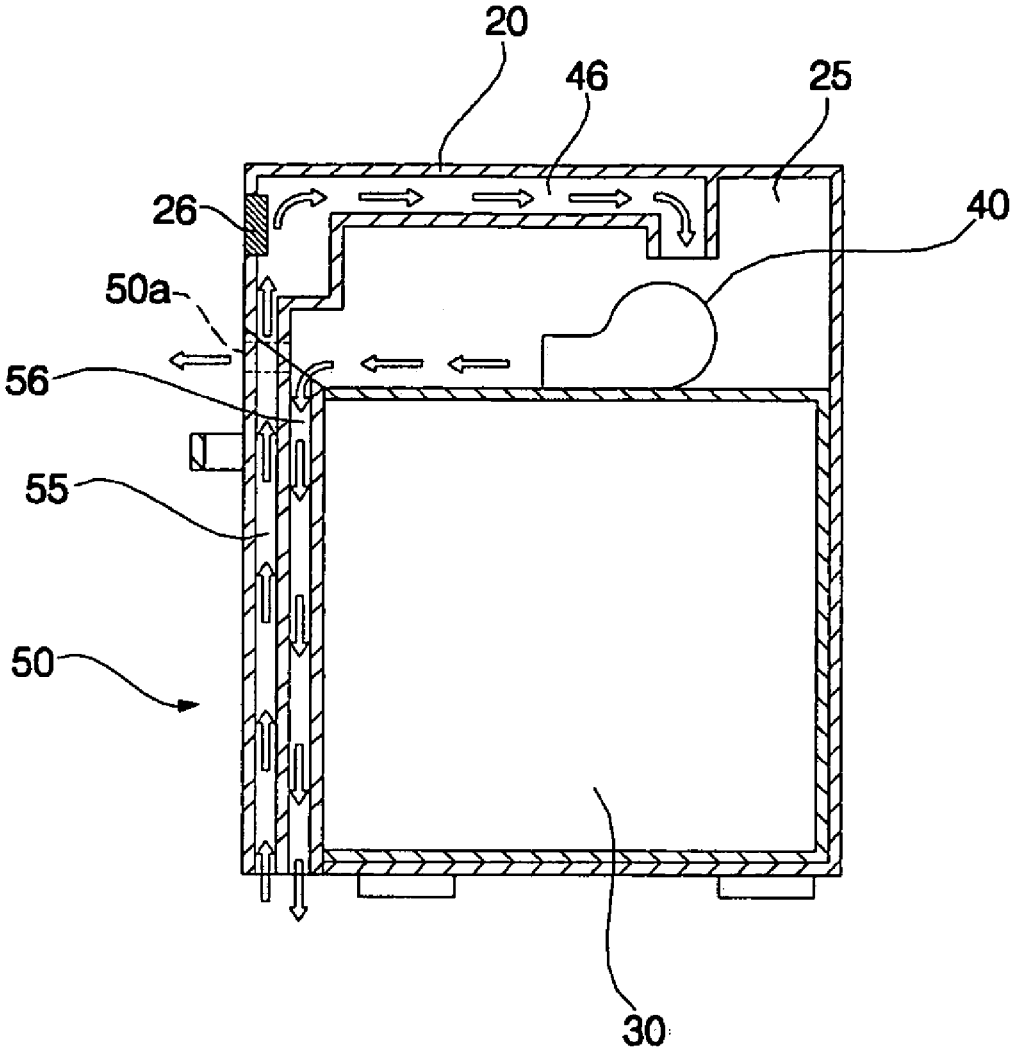
FIG. 5 is a longitudinal sectional view of a cooking appliance having a cooling apparatus in accordance with a second embodiment of the present invention.

FIG. 5 is a longitudinal sectional view of a cooking appliance having a cooling apparatus in accordance with a second embodiment of the present invention. In the second embodiment of the present invention, a suction duct 46 is connected between the suction channel 55 and the air blower 40. The suction duct 46, which connects the upper end of the suction channel 55 to the air blower 40, sucks external air, and the air discharged to the inside of the electric component chamber 25 cools the inside of the electric component chamber 25, and is then discharged to the outside of the door 50 through the discharge channel 56 of the door 50.

Figure 6:
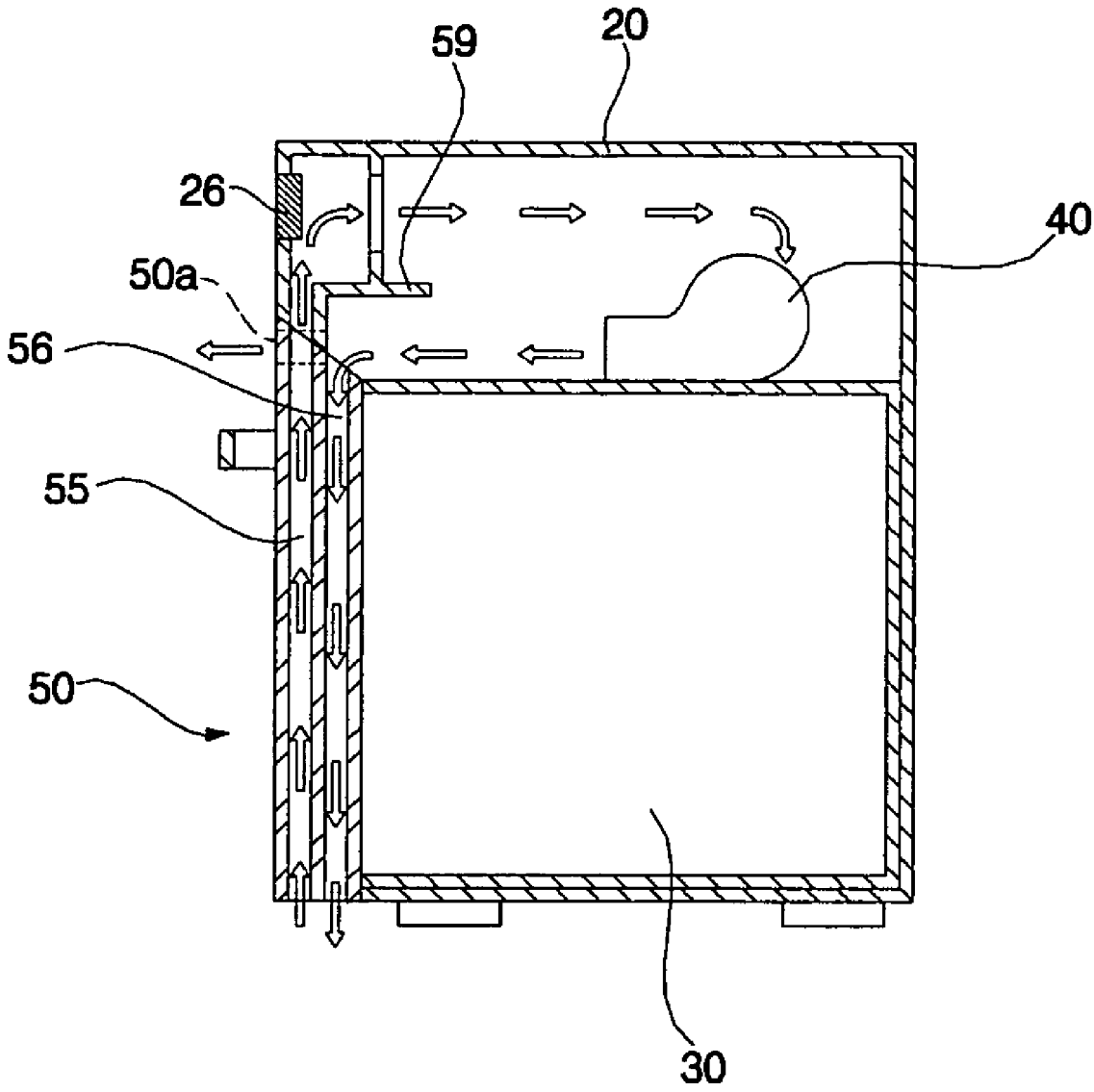
FIG. 6 is a longitudinal sectional view of a cooking appliance having a cooling apparatus in accordance with a third embodiment of the present invention.

FIG. 6 is a longitudinal sectional view of a cooking appliance having a cooling apparatus in accordance with a third embodiment of the present invention. In the preceding embodiments, the cooling apparatus comprises the discharge duct 45 or the suction duct 46. However, in the third embodiment of the present invention, the outlet of the air blower 40 faces the outlet 50*a* formed through the front surface of the door 50 and the inlet of the discharge channel 56 of the door 50 so that air is sucked through the suction channel 55 of the door 50 and discharged through the discharge channel 56 of the door 50 without a separate duct.

Preferably, a guide plate 59 for allowing the air to efficiently flow into the discharge channel 56, or guide means for concentrating the air discharged from the air blower 40 is formed at the inlet of the discharge channel 56.

Figure 7:
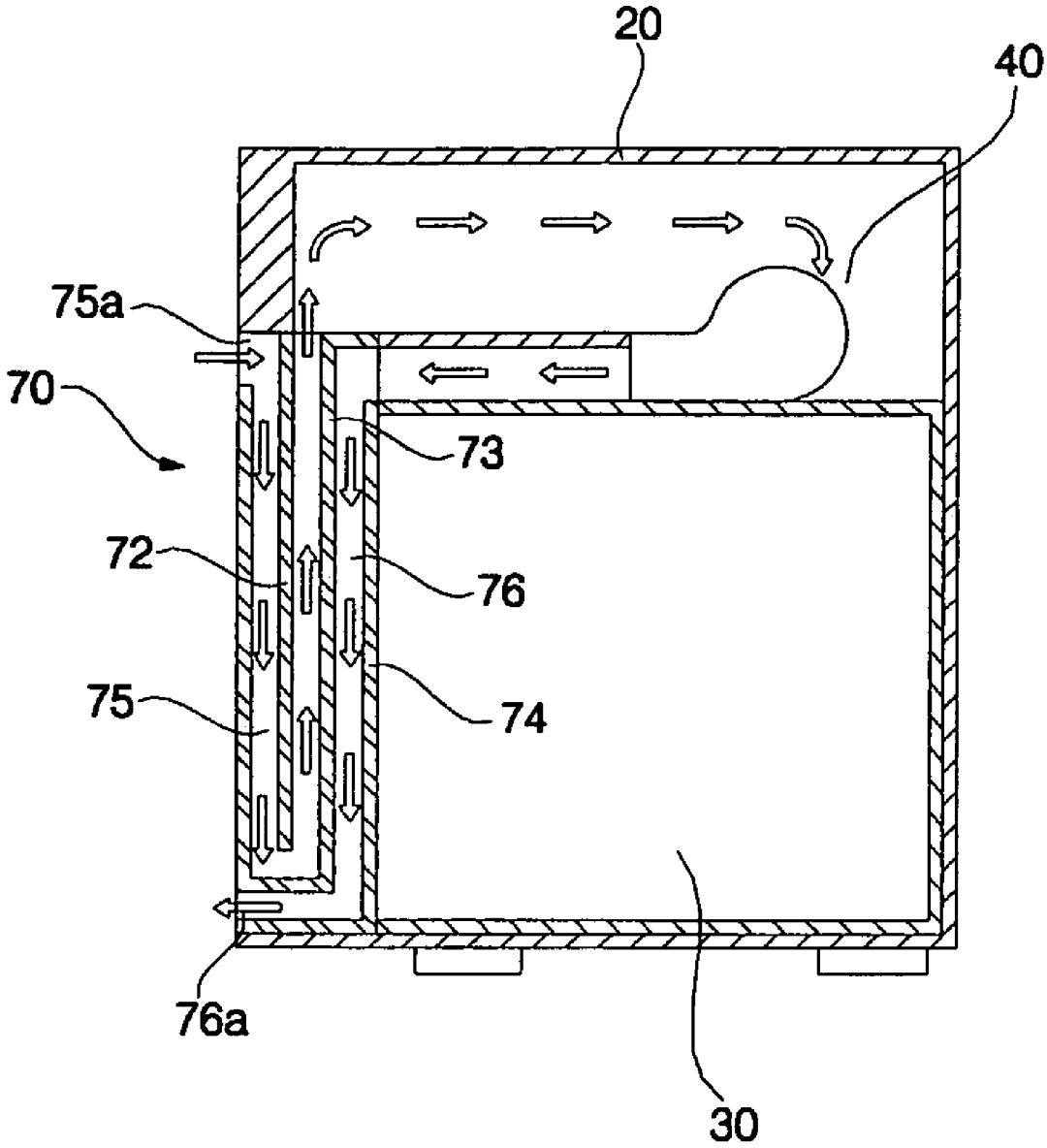
FIG. 7 is a longitudinal sectional view of a cooking appliance having a cooling apparatus in accordance with a fourth embodiment of the present invention.

FIG. 7 is a longitudinal sectional view of a cooking appliance having a cooling apparatus in accordance with a fourth embodiment of the present invention. In the fourth embodiment of the present invention, an inlet 75*a* and an outlet 76*a* are formed through separated positions of a door 70.

That is, the door 70 includes a suction channel 75 and a discharge channel 76 formed by first, second, third, and fourth plates 71, 72, 73, and 74 spaced by a designated interval, the inlet 75*a* for sucking air into the suction channel 75 is formed through the upper part of the door 70, and the outlet 76*a* for discharging the air from the discharge channel 76 is formed through the lower part of the door 70.

The separation of the positions of the inlet 75*a* and the outlet 76*a* of the door 70 prevents the air circulated through the inlet 75*a* and the outlet 76*a* from being mixed, thereby causing the air sucked through the inlet 75*a* to have a comparatively low temperature.

As apparent from the above description, the present invention provides a cooling apparatus of a cooking appliance, in which external air having a low temperature is directly sucked through a door, cools an electric component chamber, and is then discharged to the outside, thereby increasing cooling efficiency of the door.

The cooling apparatus of the cooking appliance of the present invention prevents sucked air and discharged air from being mixed, thereby increasing cooling efficiency of the inside of the electric component chamber as well as cooling efficiency of the door. Further, the cooling apparatus of the cooking appliance of the present invention prevents internal components of the cooking appliance from being damaged by heat or thermally deformed, thereby increasing safety and reliability of products.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A cooling apparatus of a cooking appliance comprising:

a cabinet having a cooking chamber located therein and an electric component chamber located outside the cooking chamber;

a door installed on the cabinet for opening and closing the cooking chamber, and having a suction channel and a discharge channel door; and an air blower installed in the electric component chamber for sucking air to the inside of the electric component chamber through the suction channel and then discharging the air through the discharge channel, wherein the door includes a plurality of plate members spaced from each other and disposed in a substantially perpendicular direction, and the suction channel and the discharge channel are formed among the plate members, wherein an inlet is formed at a lower surface of the door, and the suction channel communicates with the inlet and the electric component chamber such that an external air sucked though the inlet flows through the suction channel from a lower part of the door towards an upper part of the door, and is sucked into the electric component chamber, wherein an outlet is formed at the lower surface of the door, the discharge channel communicates with the outlet and the electric component chamber such that the air sucked into the electric component chamber flows through the discharge chamber from the upper part of the door towards the lower part of the door, and is discharged from the door through the outlet.

2. The cooling apparatus as set forth in claim 1, wherein the door includes at least three glass plate members.

3. The cooling apparatus as set forth in claim 1, wherein the suction channel is located at the outer portion of the door, and the discharge channel is located at the inner portion of the door.

4. The cooling apparatus as set forth in claim 1, wherein an outlet for discharging a part of the air discharged from the electric component chamber is formed through the upper end of the door.

5. The cooling apparatus as set forth in claim 1, wherein a discharge duct for discharging the air in the electric component chamber is formed from an outlet of the air blower to the discharge channel of the door.

6. The cooling apparatus as set forth in claim 1, wherein a guide is installed in the discharge channel to guide air flowing through the discharge channel towards two sides of the lower surface of the door.

7. The cooling apparatus as set forth in claim 6, wherein the inlet is formed at a portion including a middle portion of the lower surface of the door.

8. The cooling apparatus as set for the in claim 1, wherein an outlet of the discharge channel is formed at each side of the lower surface of the door.

9. The cooling apparatus as set forth in claim 8, wherein the inlet is formed at a portion including a middle portion of the lower surface of the door.

10. The cooling apparatus as set forth in claim 1, wherein a passage for passing the air is formed at the upper part of the cabinet at which a control panel is disposed such that the air sucked from the suction channel flows through the passage to cool the control panel before being sucked into the electric component chamber.

11. A cooling apparatus of a cooking appliance, in which external air passes through a suction channel of a door installed on a front surface of a cabinet to cool the door, flows into an electric component chamber of the cabinet to cool internal components, and is then discharged through a discharge channel of the door to the outside of the cabinet, wherein an inlet is formed at a lower surface of the door, and the suction channel communicates with the inlet and the electric component chamber such that an external air sucked through the inlet flows through the suction channel from a lower part of the door towards an upper part of the door, and is sucked into the electric component chamber, wherein an outlet is formed at the lower surface of the door, the discharge channel communicates with the outlet and the electric component chamber such that the air sucked into the electric component chamber flows through the discharge chamber from the upper part of the door towards the lower part of the door, and is discharged from the door through the outlet.

12. The cooling apparatus as set forth in claim 11 wherein an air blower for circulating the air to cool the door and the inside of the cabinet is provided in the cabinet.

13. A cooling apparatus of a cooking appliance comprising:

a cabinet having a cooking chamber and an electric component chamber located therein;

a door installed on the cabinet for opening and closing the cooking chamber, and having channels for passing air located therein; and an air blower installed outside the cooking chamber in the cabinet for forcibly circulating the air to suck external air into the cabinet through the channels of the door and cool the inside of the cabinet, wherein the channels of the door include a suction channel and a discharge channel, wherein an inlet is formed at a lower surface of the door, and the suction channel communicates with the inlet and the electric component chamber such that an external air sucked through the inlet flows through the suction channel from a lower part of the door towards an upper part of the door, and is sucked into the electric component chamber, wherein an outlet is formed at the lower surface of the door, the discharge channel communicates with the outlet and the electric component chamber such that the air sucked into the electric component chamber flows through the discharge chamber from the upper part of the door towards the lower part of the door, and is discharged from the door through the outlet.

14. The cooling apparatus as set forth in claim 13, wherein the suction channel is located at the outer portion of the door, and the discharge channel is located at the inner portion of the door.

15. The cooling apparatus as set forth in claim 13, wherein the door includes a plurality of plate members spaced from each other by a designated interval, and the suction channel and the discharge channel are formed among the plate members.

16. The cooling apparatus as set forth in claim 15, wherein the door includes three plate members.

17. The cooling apparatus as set forth in claim 13, wherein an outlet for discharging a part of the air discharged from the electric component chamber is formed through the upper end of the door.

* * * * *